US006280180B1

(12) United States Patent
Fredin-Garcia-Jurado et al.

(10) Patent No.: US 6,280,180 B1
(45) Date of Patent: Aug. 28, 2001

(54) METHOD AND SYSTEM FOR IGNITING A BURNER OF A GAS STOVE

(75) Inventors: David H. Fredin-Garcia-Jurado; Alfonso Perez-Garcia, both of San Luis Potostí (MX)

(73) Assignee: Vitromatic Comercial, S.A. DE C.V., Monterrey (MX)

( * ) Notice: Subject to any disclaimer, the term of this patent is extended or adjusted under 35 U.S.C. 154(b) by 0 days.

(21) Appl. No.: 09/537,015

(22) Filed: Mar. 28, 2000

(30) Foreign Application Priority Data

Jul. 16, 1999 (MX) ..... 996636

(51) Int. Cl.[7] ..... F23N 5/00

(52) U.S. Cl. ..... 431/27; 431/69; 431/71; 431/78; 431/281; 126/39 E

(58) Field of Search ..... 431/15, 14, 13, 431/27, 69, 70, 71, 281; 126/39 BA, 39 E

(56) References Cited

U.S. PATENT DOCUMENTS

| | | | | |
|---|---|---|---|---|
| 2,642,132 | * | 6/1953 | Mayer | 431/15 |
| 3,610,790 | * | 10/1971 | Lindberg | 431/69 |
| 3,644,074 | * | 2/1972 | Cade | 431/69 |
| 3,914,092 | | 10/1975 | Matthews | 431/66 |
| 3,986,813 | | 10/1976 | Hewitt | 431/46 |
| 4,055,164 | | 10/1977 | Wu-Heng | 126/351 |
| 4,082,493 | | 4/1978 | Dahlgren | 431/25 |
| 4,111,639 | | 9/1978 | Matthews | 431/25 |
| 4,147,494 | * | 4/1979 | Ando et al. | 431/71 |
| 4,156,432 | * | 5/1979 | Helwig, Jr. | 431/78 |
| 4,652,231 | * | 3/1987 | Berlincourt | 431/69 |
| 5,244,379 | * | 9/1993 | Stirling et al. | 431/15 |
| 5,435,717 | * | 7/1995 | Bohan, Jr. et al. | 431/69 |

* cited by examiner

*Primary Examiner*—James C. Yeung
(74) *Attorney, Agent, or Firm*—Abelman, Frayne & Schwab

(57) ABSTRACT

A method and a system for igniting a gas burner of a gas stove is disclosed, which includes a spark generating circuit to produce sparks for igniting gas burners and a plurality of electrodes which are connected with the spark generating circuit for the ignition of the gas burners. A flame sensor circuit is operated in a first period for producing sparks, through of the electrodes, and in a second period and once the gas burner has been ignited, for sensing the presence of flame on each gas burner. A power source is connected for limiting the voltage to the flame sensor circuit. A reestablishing circuit, a current sensor circuit and control means are connected for generating first activation signals for the ignition of the burner, for monitoring the presence of flame on the burner and for emitting first sound signals to indicate that the burner has been ignited and, if no presence of flame is detected on the burner, for generating second activation signals for re-igniting the burner until that a maximum time for the ignition of the burner has been exceed. Alarm signals are generated once the maximum time for the ignition of the burner has been finished.

2 Claims, 2 Drawing Sheets

METHOD AND SYSTEM FOR IGNITING A BURNER OF A GAS STOVE

FIELD OF THE INVENTION

The present invention is referred to a electronic ignition system for gas stoves and more particularly, to an electronic ignition system for burners of gas stoves which includes an electronic circuit in order to carry out the steps of igniting a gas bumer, re-igniting a gas burner, detecting the absence of flame, monitoring the flame, closing a security valve and starting an audiovisual alarm for the igniting of the burners of a gas stove.

BACKGROUND OF THE INVENTION

A typical system to ignite an oven burner of a gas stove comprises mainly to partially turn on a gas valve to leave gas through a pilot burner and to ignite the pilot burner manually with a lighted match or by means of a manual electric igniter. Once the pilot burner is ignited, the gas valve is completely open in order to ignite the burner of the oven.

However, one of the main problems of the typical system is that, sometimes, the oven burner does not ignite, whether the pilot burner is turned off at the moment that the oven burner is ignited or by air flows. In this way, a dangerous concentration of gas within the oven is provoked, and the user immediately need to turned off the gas valve. If the user wanted to turn the burner on again, he or she would had have to ventilate the area to prevent from a possible ignition of gas, that would cause an explosion.

At the present, there are some ignition systems for the ignition of gas burners, which already use electronic ignition systems. For example, The U.S. Pat. No. 3,914,092 assigned to Johnson Service Controls, it is referred to a direct spark ignition system for generating ignition sparks for igniting fuel discharged by a fuel outlet.

Another system for controlling a pilot burner and main burner gas valves of a gas furnace is shown in the U.S. Pat. No. 3,986,813 assigned to Cam-Stat Incorporated, including a pilot spark igniter and a pilot flame sensor. The system includes a relay having a first standby mode providing power to a spark ignitor circuit so that, when the thermostat switch is closed, a pilot valve solenoid is energized, and in a second operating mode disconnecting power from the power from the spark ignitor circuit and providing power to the main valve solenoid when the flame is sensed at the pilot burner. The system is provided with a fast responding circuit for operating the relay utilizing a 24 volts supply, with a 48 volts supply provided only for the flame sensor.

Other arrangements of gas burners that already use electronic ignition systems to operate are described and claimed in the U.S. Pat. Nos. 4,055,164; 4,082,493; 4,111,639; and 4,194,875, all of them related with control systems for the automatic ignition of the burners. However, in all the cases, these are referred for controlling the pilot and the main burner gas valves (U.S. Pat. Nos. 4,082,493 and 4,194,875); for controlling the ignition of an auxiliary fire nozzle and a main fire nozzle in a water heater (U.S. Pat. No. 4,055,164); or to a self-checking fuel ignition system, which effects periodic testing of the operability of the spark generating circuit (U.S. Pat. No. 4,111,639).

Finally, the applicant of the present invention, in its Mexican Patent application SN 964738 makes reference to an electronic ignition system for a gas stove. The system is shown in combination with a plurality of burners, which are located on the upper part of the stove and inside the oven of said stove. A plurality of electrodes are placed near and in coincidence with each burner, each electrode being activated to provide ignition sparks for the ignition of each burner. A spark generating circuit is connected with all the electrodes in order to generate the enough ignition sparks for igniting each burner. A plurality of switching means, which are connected to spark generating circuit, the switching means being independently connected by each one of a series of valves on the stove. So, each time that a valve is open, the spark generating circuit is activated in order to provide ignition sparks by each electrode of each burner. And a power source connected to the spark generating circuit. The improvement in this system being characterized by, a flame sensor circuit connected between the spark generating circuit and at least one electrode, which in a first operating period and once the spark generating circuit has been activated for igniting one or more burners, it is operable to detect the absence of flame on the burners producing a sound by means of a buzzer, and in a second period, it is operated for detecting the presence of flame in the burner, and emitting a visual signal, once the burners have been ignited.

As can be seen of the above, the application of electronic circuits for the ignition of gas burners has been advancing in different areas. So, the present application is referred to the application of an electronic ignition system for burners of gas stoves, which is an improvement to the Mexican patent application 964738 (U.S. patent application Ser. No. 141976).

The electronic ignition system is show in combination with a plurality of burners, which are located on the upper part of the stove and a burner inside the oven. A plurality of electrodes are placed near and in coincidence with each burner, each electrode being activated to provide ignition sparks for the ignition of each burner. A spark generating circuit is connected with all the electrodes in order to generate the enough ignition sparks for igniting each burner. A plurality of switching means, which are connected to spark generating circuit, the switching means being independently connected by each one of a series of valves on the stove. So, each time that a valve is open, the spark generating circuit is activated in order to provide ignition sparks by each electrode of each burner. And a power source connected to the spark generating circuit. The improvements being characterized by a reestablish circuit connected to the power source; a circuit for controlling a security valve, the security valve being closed after that various attempt for re-igniting the burner has been made and absence of flame is being detected on the burner; and a microprocessor connected to a circuit for the protection of low voltage, to a flame rectifying circuit and to the circuit for controlling a security valve, said microprocessor being programmed to generate first activation signals for the ignition of the burner, for monitoring the presence of flame on the burner and for emitting first sound signals to indicate that the burner has been ignited and, if no presence of flame is detected on the burner, for generating second activation signals in order to try again of ignite the burner until a maximum predetermined time period for the ignition of the burner has been exceed, said microprocessor generating alarm signals once the time for the ignition of the burner has been finished and for closing the flow of gas toward the burner.

OBJECTIVES OF THE INVENTION

An objective of the present invention is to provide a method and a system for igniting burners of a gas stove, which is operated to carry out a flame sensing system in each burner.

Is other objective of the present invention, to provide a method and a system for igniting burners of a gas stove, which includes a re-igniting sequence for the ignition of the burner during a maximum predetermined time period.

An additional objective of the present invention is to provide a method and a system for igniting burners of a gas stove, which includes a security valve that is closed after that "n" attempts for re-igniting the burner and that absence of flame on the burner is detected.

An additional objective of the present invention is to provide a method and a system for igniting burners of a gas stove, which includes an electronic circuit to carry out the sequences of normal ignition of the burner, re-ignition of the burner, detection of absence of flame in the burner, monitoring the presence of flame in the burner and closing of a security valve with an audiovisual alarm, all of them during the ignition of the burners on the stove.

These and other objects and advantages of the present invention shall be evident to the experts in the field, from the detailed description of this invention, as follows.

BRIEF DESCRIPTION OF THE DRAWINGS

The FIG. 1 is a schematic diagram illustrating the electronic ignition system for an oven of a gas stove; and, The FIG. 2 is an electric diagram of the ignition circuit that is used with the present invention.

DETAILED DESCRIPTION OF THE INVENTION

Figure 1:
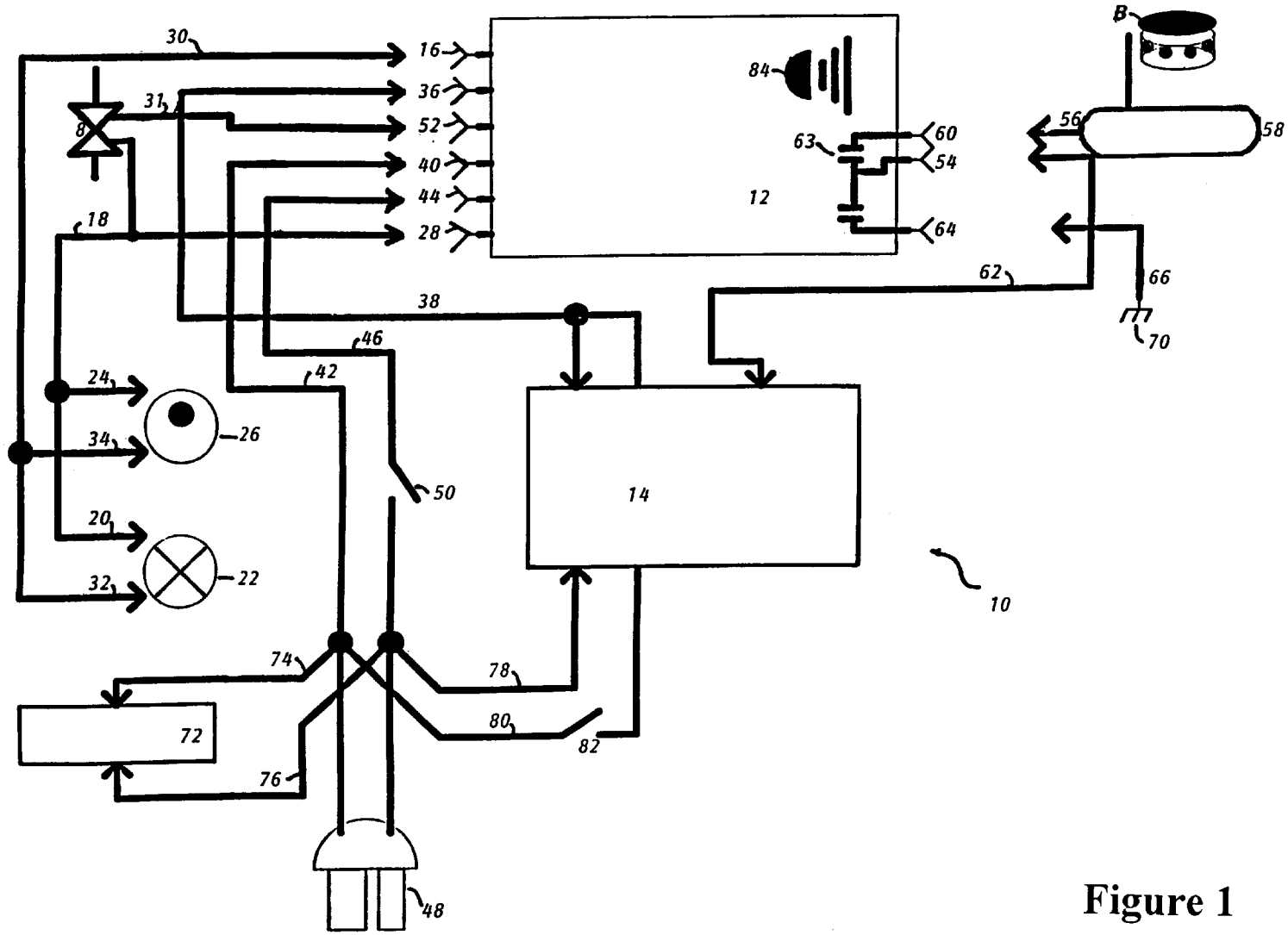

Having now more particularly reference to a preferred embodiment of the present invention, illustrated through the various figures, wherein like parts are designated by like reference characters, wherein the FIG. 1 is showing a schematic diagram illustrating an electronic ignition system 10 for an oven of a gas stove, in accordance with the present invention. At the FIG. 1 is showing a schematic diagram of the electronic ignition system 10, which includes an ignition circuit 12 for effecting the operations of normal ignition of the burner, re-ignition of the burner, detection of absence of flame in the burner, sensing the presence of flame in the burner and closing of a security valve with an audiovisual alarm, all of them during the ignition of the burner B of the oven of the stove; and a high-voltage module 14 to produce sparks for igniting each of said plurality of gas burners B, by means of the functioning of the ignition circuit 12.

As can be seen in the diagram above illustrated in the FIG. 1, the ignition circuit 12 comprising nine terminals: a first terminal 28 is connected by means of the line 18 to the cathode 20 of an electric lamp 22 used to illuminate the interior of the oven and, also is connected in parallel to the cathode 24 of a neon lamp 26. A second terminal 16 is connected by means of the line 30 to the anode 32 of said electric lamp 22 and is connected in parallel to the anode of said neon lamp 26. A third terminal 36 is connected by means of the line 38 to the high-voltage module 14. A fourth terminal 40 is connected to a neutral line 42 of a power source of 110 volts. A fifth terminal 44 is connected to a line 46 to provide together with the neutral line 42, the energy to operate the ignition circuit 12. Both lines 42 and 44, having a plug 48 to be connected to a power source in order to provide energy to the electronic ignition system. The control is energized by means of knob switch 50, which is connected in series with the supply line 46. A sixth terminal 52 is connected to a security valve 8, by means of a line 31, which is used to close the gas flow toward the burner B, when no presence of flame is detected in said burner.

A seventh terminal 60 by means of line 56 is connected to the electrode 58 to provide an exit of high voltage from the high-voltage module 14, for the ignition of the burner B in the oven of the stove.

An eight terminal 54 is connected by means of the line 52 to the high-voltage module 14, in order to receive the required voltage to generate sparks in the electrode 58 for the ignition of the burner B by means of the ignition circuit 12. And, a nine terminal 64 is connected by means of the line 66 to the chassis of the stove, which has the function as a ground terminal and is showed in an schematic way with the number 70.

A gap 63 formed between the proximity of the seventh terminal 60 and the eight terminal 54, which in a first period, is used to provide a path of voltage from the terminals 60 and 54 and in a second period, to insolate the flame current rectification that is being provided by the electrode 58 and so, to avoid a confusion with a second rectification current that is being provided by a complementary electrode to the electrode 58.

With reference to the current lines 42 and 46, these are connected in parallel to a clock 72, by means of the lines 74 and 76. The current lines 42 and 46 also are connected in parallel to the high-voltage module 14 by means of the current line 78 and the neutral line 80, in order to provide the necessary energy for generating sparks. A switch 82 is connected in series with the neutral line 80, one by each burner knob of the stove. The ignition circuit 12 also includes a buzzer 84, which in a first period is provided to emit signals to advice that the burner has been ignited. The buzzer 84 will emit alarm signals, in case of that the burner, after that a predetermined time. period has been exceeded and the burner not has been ignited.

Figure 2:
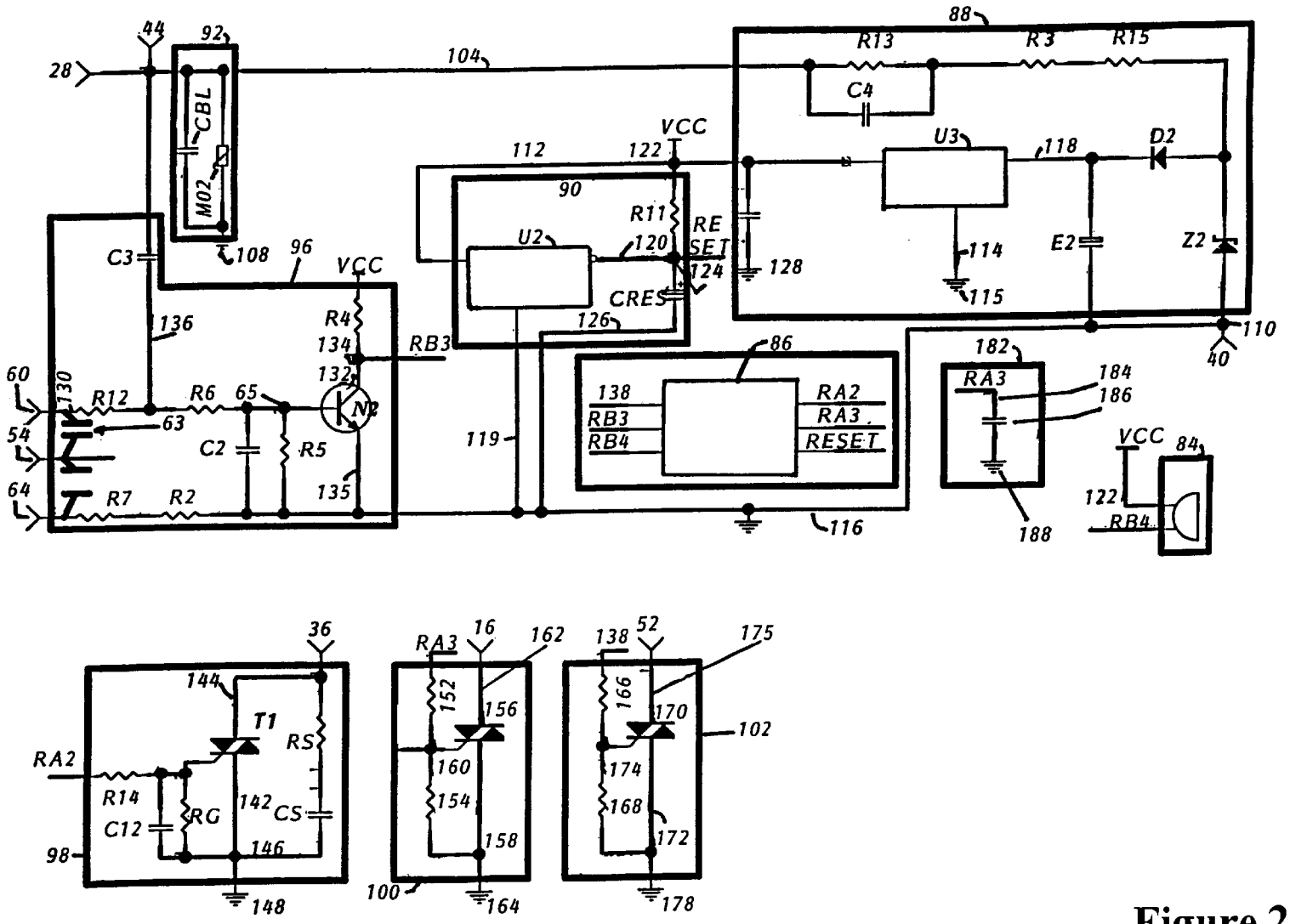

Making now particular reference to FIG. 2, this illustrate a electric diagram for the electronic ignition circuit 12, which comprises a power supply circuit 88; a circuit for the protection of low voltage 90; a transitory voltage protector circuit 92; and flame rectifying circuit 96; a series of solid-state switches 98, 100 and 102; and a microprocessor 86 for receiving and processing the diverse signals that has been detected by the components above for effecting the operations of normal ignition of the burner, re-ignition of the burner, detection of absence of flame in the burner, monitoring the presence of flame in the burner, closing of a security valve and audiovisual alarm.

The electronic ignition circuit 12, as is illustrated in the FIG. 2, is connected by means of the terminals 44 and 40 to the lines 42 and 46, which also are connected to a power source (not show). As can be seen of the FIG. 2, the transitory voltage protector circuit 92 is connected through of the line 104. The transitory voltage protector circuit 92 comprising a capacitor CBL and a filter M02 for the protection of the transitory voltage in the circuit, which are connected to a ground 108.

The line 104 also is connected to the power supply circuit 88 as is showed in the FIG. 2, which comprises, a resistor RI 3, which is connected in series to the line 104 and a capacitor C4 for limiting the input voltage. The resistor R13 and the capacitor C4 are presenting an impedance of 60 Hz in order to diminish the exit of the current supply line. The transitory voltage protector circuit 92, the resistor R13 and the capacitor C4, also have the function for the protection of high voltage protections and for the transitory perturbations in the supply line.

The supply line continues with two resistors R3 and R15, which limit the current and the voltage for the protection of the circuit, and a zener diode Z2, which is connected in series at the point 110 with the neutral line 40 of the circuit 12. Furthermore, a line 118 is connected to a diode D2, to couple the half-wave rectified current by diode Z2, toward a voltage regulator U3 for regulating the voltage VCC of the circuit by means of the line 122. The voltage regulator U3 is connected to a ground 115 by means of the line 114. A capacitor E2 is connected in parallel between the line 118 and the line 116 in order to establish a voltage of direct current. Said line 116 being a derivation of the neutral line 40. Said line 116 being connected to the fourth terminal 40, which is also connected to the ground of the stove by means of the line 42, as is illustrated in FIG. 1.

The other exit of the buzzer 84 is connected by means of the line RB4 to the microprocessor 86. In the union point 124 of the resistor R 1I and the line 120, a capacitor CRES is connected by means a line 126, which is a derivation of the neutral line 40. The capacitor CRES conjunctly with the resistor R11 and the monitor of low voltage U2, are used for establishing a reset voltage for the microprocessor 86. The line 126 is connected with the line 116. Likewise, in the point 124 is derived a line RESET, which is connected to the microprocessor 86. In the line 112, between an exit of the voltage regulator U3 is connected in parallel a capacitor C, which is connected a ground terminal 128. On the other hand, the monitor of low voltage U2 is connected through the line 119 to the line 116.

Making reference to the flame rectifying circuit 96 is comprises a high impedance resistor R12, which is connected in series by means of a line 130 to the terminal 54, in order to increase the input impedance. Said resistor R12 is connected in series to the resistor R6 in order to provoke a polarization to the bas of the transistor N2. An exit line 132 of the transistor N2 is connected with the resistor R4 through of the point 134, for supply the voltage of the circuit to 5 volts. The other exit line 135 of the transistor N2 is connected with the line 116. Between the base of N2 and the line 116, is connected in parallel a capacitor C2, which function as a filter for the rectified current of ionization, as well as, a resistor R5 for helping to the resistor R6 in the polarization of the transistor N2. Two resistors in series R2 and R7 are connected to the line 116, which is connected to the terminal 64 of the frame of the stove (no show). Finally, the flame rectifying circuit 96 is connected by means of the line RB3 to the microprocessor 86 and by means of the line 136 to the to the terminal 44. Said line 136 including a capacitor C3, which is connected in series to the line 104. The line 60 of flame rectifying circuit 96 is connected to the electrode 58 by means of the supply line 56. A gap 63 is introduced between the two terminals 54 and 60 in order to separate the ionization signal that is arriving of the electrode 58, for identifying in that burner the flame is being detected.

The flame detecting step is carried out by means of an ionization-rectification method. This method consists in apply a voltage between two electrodes (for example between the electrode 58 and the burner B) wherein the current circulates more easily due to an ionized environment. So, in a first operation period, the high-voltage module 14 (also called spark generating circuit) is activated when the solid-state switch 98 is closed. The sparks are established by means of the flame rectifying circuit 96 through of the terminal 54, the gap 63 and the terminal 60, which are disconnected by means of the high impedance resistor R12 in a flame detecting step.

In this first operation period, the flame is not present in the burner B and the resistor R12, resistor R6 and resistor R5, as well as the capacitor C2 and capacitor C3 of the flame detecting step are used to generate a sine wave with zero-offset in the point 65, wherein the transistor N2 is polarized.

In a second operation period, the solid-state switch 98 is deactivated in order to does not generate more sparks due that the flame in the burner has been detected. The electrode 58 that was used to discharge the sparks toward the burner B, now is rehabilitated as a flame sensor, which presents a voltage in the terminal of the electrode 58 and in said burner B. Due that the electrode 58 is immersed in the flame, the environment is ionized and a rectified current is established, which is detected in the terminals 60 and 64 of the flame rectifying circuit 96.

A first solid-state switch 98 is connected to the high-voltage module 14 by means of the terminal 36 (FIG. 1) and by means of the line RA2 to the microprocessor 86. Said solid-state switch 98 comprising a first resistor R14 for reducing the voltage and for limiting the regulated current to the gate of the thyristor T1. A capacitor C12 for filtering the shooting pulses, said capacitor C12 being connected in parallel with the second resistor RG; this second polarization resistor RG also is connected to the gate of the thyristor T1. The resistor RG and the resistor R14 are used to shoot to the gate the thyristor T1. Said thyristor T1 receives the signal of the microprocessor 86 and permits the pass of alternating current for energizing the sparks generating circuit 14. The thyristor having two lines 142 and 144. The line 142 being connected with the neutral line to a ground terminal 148 and the line 144 being connected to the terminal 36. Furthermore, a capacitor CS and a resistor are included, which are connected in series by means of the line 146 for diminishing the phase difference in the voltage and the current. The thyristor T1 is connected to the terminal 36, which is also connected to the line 38 of the high-voltage module 14.

A second solid-state switch 100 for controlling the neon lamp 26 and oven lamp 22 is connected by means of the line RA3 to the microprocessor 86. Said second solid-state switch 100 comprising a first resistor 152 for reducing the voltage and for limiting the current to the gate of thyristor 156. A second polarization resistor 154 also is connected to the gate of the thyristor 156. The resistor 154 and the resistor 152 are connected in series by means of the line 160, for releasing the gate of the thyristor 156. Said thyristor 156 receives the signal of the microprocessor 86 and permits the flow of alternating current for energizing the neon lamp 26 and the oven lamp 22. The thyristor 156 having two lines 158 and 162. The line 158 being connected with the neutral line to a ground terminal 164 and the line 162 is connected to the terminal 16. The thyristor 156 is connected to the terminal 16, which also connected to the line 30 of the system 10.

A third solid-state switch 102 for controlling a valve 8 of the oven, said third solid-state switch 102 being connected by means of the terminal 52 to said valve of the oven 8 and by means of the line 138 to the microprocessor 86. Said solid-state switch 102 comprising a first resistor 166 for reducing the voltage and for limiting the current to the gate of the thyristor 170. A second polarization resistor 168 also connected to the gate of the thyristor 170. The resistor 168 and the resistor 166 being connected en series by means of the line 174, for shooting to the gate of thyristor 170. Said thyristor 170 receives the signal of the microprocessor 86 and permits the flow of alternating current for energizing the valve 8. The thyristor 170 having two lines 172 and 175. The line 172 is connected with the neutral line toward a ground connector 178. In the same way, the line 175 is connected to the terminal 52, which is also connected to the line 31 of the system 10.

Finally, an electric noise filter 182 is connected by means of the line RA3 to microprocessor 86. The electric noise filter 182 is connected by means of a line 184 to a capacitor 186, which is connected to the ground terminal 188.

OPERATION CIRCUIT

In accordance with the above, for igniting the electronic ignition of the burner B, the electronic ignition circuit 12 is energized. The sequence is initiated when the rotary knob of the oven or stove (not show) is turned on. Once that the sequence of ignition has been ignited, the high-voltage module 14 is activated; the buzzer 84 is activated; and in this step is monitored a first presence of flame in the burner by means of the electrode 58. In accordance to the sensing of the flame, the electronic ignition circuit 12 enters in a sensing step (by means a program stored in the microprocessor 86). If the presence of flame has been detected in the circuit 12, then the buzzer 84 emits a series of signals (sounds) to advice to the operator that the burner B has been ignited. If not presence of flame has been detected in the circuit 12, then the control circuit will initiate other ignition sequence. When a period of time established in the microprocessor 86 (for example from 8 to 10 seconds) had finished and no presence of flame has been detected in the burner, the control circuit will initiate a second alarm signal that will start-up in a simultaneous way and in an intermittent sequence, the neon lamp 26, the oven lamp 22 and with the emission of sounds in the buzzer 84. Once the time period for igniting the burner B has been finished, the control circuit 12 will effectuate a closing step of a security valve (not show) to close the gas flow toward the gas burner B.

In accordance with the above the method for the ignition of a gas burner in accordance with the present invention comprising the steps of:

Activating the high-voltage module 14 and the flame rectifying circuit 96 for the ignition of the burner B;

Detecting by means of the flame rectifying circuit 96, a first representative signal of absence of flame in the burner B;

Processing the first signal of absence of flame in the burner B in the microprocessor 86, in order to emit first activation signals and to send the signals to the microprocessor 86, informing that presence of flame in the burner B was detected; and if not presence of flame is detected in the burner B. generating second activation signals in the flame rectifying circuit 96, to try again the ignition of the burner B until a period of time established in the microprocessor 86 (in a maximum predetermined time) and to indicate that the time for the ignition of the burner B has finished;

Generating alarm signals by means of the buzzer 84, the first solid-state switch 98, the second solid-state 100 and the third solid-state switch 102, all of them connected to the microprocessor 86, once the maximum time for igniting the burner B has been finished within the microprocessor 86; and, Closing a security valve for cutting the gas flow toward the burner B, once the maximum time for igniting the burner has finished.

The method for igniting a gas burner including the step of:

monitoring a signal of presence of flame on the burner, when the electric current is interrupted.

The method for igniting a gas burner including the step of:

emitting simultaneously visual signals and sound emission in order to indicate that a maximum time period for the ignition of the burner has been exceed.

As can be seen of the above an embodiment of an electronic ignition system for the ignition of a burner of a stove has been described, which facilitate the ignition of the burners of a gas stove. However, it shall have to be understood that said invention must no be limited to the embodiment above illustrated. Thus, being evident to the specialists of the field that other arrangements, as well additional functions thereof, could be implemented, which should be clearly contained within the scope and intendment of this invention, as claimed in the following claims.

We claim:

1. An electronic ignition system for igniting a plurality of gas burners, which comprises, a spark generating circuit to produce sparks for igniting each of said plurality of gas burners; a plurality of electrodes, each one of said plurality of electrodes being connected with said spark generating circuit by a separate connection, said separate connection conducting a portion of said sparks to one of said plurality of electrodes, each one of said plurality of electrodes being mounted adjacent to a different one of said plurality of gas burners than the remainder of said plurality of electrodes, said one of said plurality of electrodes emitting said portion of said sparks for the ignition of the one of said plurality of gas burners to which said one of said plurality of electrodes is mounted adjacent; and, a flame sensor circuit (12) connected between the spark generating circuit (14) and at least one of the plurality of electrodes, said flame sensor circuit being of the type that comprises a flame rectifying circuit (96), said flame sensor circuit (12) being operated in a first period and once the spark generating circuit (14) has been activated for producing said sparks, said flame sensor circuit (12) is operated to detect the absence of flame on any of at least one of said plurality of burners, each of said at least one of the plurality of electrodes being mounted adjacent to one of said at least one of said plurality of gas burners, by means of said least one of the plurality of electrodes, and in a second period and once each of said plurality of gas burners has been ignited, said at least one of the plurality of electrodes and said flame sensor circuit (12) are operated for sensing the presence of flame on each of said at least one of said plurality of gas burners; a transitory voltage protector circuit (92) connected to a power supply circuit (88); a filter for a power source circuit for avoiding the perturbations in a power conductor line; and, a power source circuit for limiting the entrance voltage toward the flame sensor circuit, the improvement comprising:

control means (86) connected between the flame rectifying circuit (96) and a protecting circuit for low-voltage (90), said control means being programmed for generating first activation signals for the ignition of the burner, for monitoring the presence of flame on the burner, for sending first alarm signals to indicate that the burner has been ignited, for generating second activation signals if the presence of the flame is not detected on the burner in order to re-ignite the burner until a maximum time for the ignition of the burner has been exceeded, and for sending second alarm signals once the maximum time for the ignition of the burner has been finished, wherein the protecting circuit for low-voltage (90) is connected to the power supply circuit (88) for monitoring the voltage in the control means and to synchronize the control means when the system has been started;

a first solid-state circuit (98) connected between spark generating circuit (14) and the control means (86) for receiving signals of the control means and for sending current signals for energizing the spark generating circuit (14), said first solid-state circuit being closed in a first operating period when the first solid-state circuit is activated and the presence of a flame is not detected in the burner and, in a second operating period, said first solid-state circuit is deactivated to avoid generating sparks when the flame in the burner is detected;

alarm means connected between the control means (86) and the protecting circuit for low-voltage (90) for receiving the first alarm signals of the control means for emitting first sounds to indicate that the burner has been ignited, and for receiving the second alarm signals of said control means, for emitting second sounds after a maximum time for the ignition of the burner has been exceeded; and, a second solid-state circuit (100) connected to the control means (86) to receive the second alarm signals from the control means (86), said second solid-state circuit including illumination means, said alarm means and said illumination means being activated for simultaneously emitting visual signals and sounds to indicate that the maximum time for the ignition of the bumer has been exceeded.

2. The electronic ignition system for igniting a plurality of gas burners as claimed in claim 1, wherein the flame sensor circuit further comprises: a third solid-state circuit connected to the control means, for receiving third current signals of the control means and for sending said third current signals toward a security valve to close a gas flow toward the burner, said security valve being closed after attempts at re-igniting the burner have been carried out and the presence of a flame in the burner was not detected.

* * * * *